United States Patent [19]

Limpach et al.

[11] 4,428,769

[45] Jan. 31, 1984

[54] PROCESS FOR INJECTING A REDUCING AGENT INCLUDING ASH-BEARING BITUMINOUS COAL INTO THE HEARTH OF A BLAST FURNACE

[75] Inventors: Raymond Limpach, Huncherange, Luxembourg; Dietrich Boecker, Brühl, Fed. Rep. of Germany

[73] Assignees: Rheinische Braunkohlenwerke AG., Cologne, Fed. Rep. of Germany; Arbed S.A., Luxembourg, Luxembourg

[21] Appl. No.: 299,005

[22] Filed: Sep. 3, 1981

[30] Foreign Application Priority Data

Aug. 28, 1981 [DE] Fed. Rep. of Germany ..... 3034679

[51] Int. Cl.[3] ..... C21B 5/04

[52] U.S. Cl. ..... 75/30; 75/42

[58] Field of Search ..... 75/41, 42, 30

[56] References Cited

U.S. PATENT DOCUMENTS

| | | | |
|---|---|---|---|
| 1,349,598 | 8/1920 | Basset | 75/42 |
| 2,184,318 | 12/1939 | Ruzicka et al. | 75/42 |
| 4,266,968 | 5/1981 | Daldrup et al. | 75/42 |
| 4,306,507 | 12/1981 | Metz | 75/42 |

FOREIGN PATENT DOCUMENTS

| | | | |
|---|---|---|---|
| 2169 | of 1857 | United Kingdom | 75/42 |

*Primary Examiner*—M. J. Andrews

*Attorney, Agent, or Firm*—Parmelee, Miller, Welsh & Kratz

[57] ABSTRACT

In a process for injecting a fine-grain carbon carrier including ash-bearing bituminous or hard coal into a blast furnace hearth, use is made of a mix of fine-grain bituminous coal and at least one other solid fine-grain ash-bearing carbon carrier. The composition of the mix is so selected that the degree of basicity of the overall resulting ash of the mixture is adapted to the degree of basicity of the furnace slag.

10 Claims, No Drawings

PROCESS FOR INJECTING A REDUCING AGENT INCLUDING ASH-BEARING BITUMINOUS COAL INTO THE HEARTH OF A BLAST FURNACE

BACKGROUND OF THE INVENTION

The invention is concerned with a process for injecting a fine-grain carbon carrier including ash-bearing bituminous coal, as a reducing agent, into the hearth of a blast furnace.

In this specification, the terms brown coal and lignite may be used interchangeably, in other words a reference to brown coal may be taken to include lignite, unless the context indicates otherwise, and similarly a reference to lignite may be taken to include brown coal, unless the context indicates otherwise. In this connection it may be noted that although brown coal and lignite are generally considered as the same material, there may possibly be on recent knowledge a difference between the two kinds of material, both of which are thus encompassed by the present invention.

It has been proposed that the consumption of coke in a blast furnace can be reduced by using other fuels or by directly introducing a reducing agent into the blast furnace. However, the injection of coal into a blast furnace has hitherto been used only to a very limited degree, under practical operating conditions. This may be attributed inter alia to the fact that the preparation, transportation and distribution of fine-grain coal from a supply container into the inlet openings of the blast furnace, which are generally the tuyere arches or notches thereof, involve greater difficulties than when using a fluid agent, for example oil or gas. In addition, incomplete reaction in respect of the injected solid fuels will tend to result in noticeable disturbances and even breakdowns in operation of the blast furnace, for example due to the production of soot or black which would reduce the permeability of the blast-furnace burden in regard to the reducing gas and which may possibly also be present in the waste outlet gas. The latter can result in problems in the pieces of equipment through which the outlet gas subsequently flows.

If, for the purposes of achieving the desired saving, there may be a desire to use a cheaper bituminous coal, for example imported bituminous coal, a further difficulty is often encountered. Cheap bituminous coals usually have high ash contents which may vary between 15 and 25%, and the ash may contain predominantly acid constituents, When using bituminous coals of this kind therefore, there is the danger that the acid constituents of the ash may not be sufficiently quickly distributed in the blast furnace slag, and the resulting non-homogeneous oxide mixtures have poor flow properties and interfere with operation of the blast furnace.

SUMMARY OF THE INVENTION

An object of the present invention is to provide a process of operating a blast furnace in a low-cost manner.

A further object of the invention is to provide a process of injecting fuel into the hearth of a blast furnace, which permits use of a low-cost fuel without the consequence of severe perturbations in operation of the furnace or equipment downstream thereof.

A still further object of the invention is a process of injecting a solid fuel into a blast furnace hearth, in the form of a fine-grain hard or bituminous coal, even when it is a high-ash coal.

These and other objects are achieved by the process according to this invention, wherein a mixture of fine-grain bituminous coal and at least one other solid fine-grain ash-bearing reducing agent or carbon carrier is used. The composition of the mixture is so selected that the degree of basicity of the overall ash of the mixture is adapted to the optimum extent to the degree of basicity of the blast furnace slag.

DESCRIPTION OF THE PREFERRED EMBODIMENTS

The process is preferably one of continuous injection.

A reducing agent of the above-indicated kind is for example brown coal or lignite. A typical brown coal has an ash content of 4 to 5%, of which approximately 60% comprises CaO and MgO. These conditions may also occur in respect of lignite. It is also possible to use cokes which are produced from the above-indicated carbon carriers and the ash content of which may even be somewhat higher.

An embodiment of the process provides for using peat and/or peat coke, which both contain basic ashes. Sawdust, fine wood chippings and the like, all of which are encompassed by the term sawdust in this specification, can also be advantageously used as the reducing agent.

The use of a mixture of bituminous coal and brown coal and/or lignite and/or peat and/or cokes produced from the above-indicated substances, in a suitably fine grain size, promotes the completest possible reaction in the blast furnace, within the short period of time available for that purpose, as those substances are highly reactive. Added to this is the further advantage that the supply of such a mixture to a blast furnace does not give rise to any serious operating difficulties.

Another particularly advantageous consideration is the fact that the operation of reducing brown coal, lignite, peat and the cokes produced therefrom to the required degree of fineness does not cause excessively high costs. The fact that it is possible to leave a water content of up to 15%, preferably up to 10%, in the mixture, also has an advantageous effect in regard to costs. In actual fact, the water content can have the result that, upon entering the blast furnace, the high temperature of from about 1000° to 1650° C. which then suddenly acts on the introduced matter causes the water to evaporate in an explosive manner and the coal grain which is already small in any case bursts, together with the other volatile constituents which are also driven out in an explosive manner, so that the specific surface area of the substance is increased, with the result that the conversion reaction in the blast furnace takes place even more rapidly. On the other hand, the water content is so low that the amount of heat required for the blast furnace is not noticeably affected.

The carrier gas which passes with the mixture into the blast furnace, for example cold air, may be less than 3%, and possibly about 1%, of the total hot blast which is injected through the tuyere arches or notches. The amount of gas used is too low for it to be able to have a noticeable affect on the thermal balance sheet of the blast furnace. In any case, provision is made, as far as possible, for the speed at which the particles of dust issue from the supply conduit into the blast furnace, to be less than 50 meters/second, and preferably less than 25 meters/second. It may be readily possible for the speed of injection to be reduced as low as the speed of burning back, which is of the order of about 18 meters/-second. A low injection speed of this kind, which is substantially lower than the speed of about 120 to 220 meters/second at which the hot blast, which is normally at a temperature of from about 1100° to 1200° C., is blown into the furnace through the tuyere arches or notches, increases the length of the residence time of the particles of dust in the region which is in front of each tuyere and which is more or less empty.

The above-described process according to the invention permits the injection of comparatively large amounts of carbon and thus a noticeable reduction in the consumption of coke or complete substitution of the heavy oil which has been predominantly used hitherto. This is to be attributed to the above-mentioned fact that no serious difficulties occur or arise either when transporting the material into the blast furnace or in reaction within the blast furnace. The extent to which coke can be replaced by another auxiliary fuel is thus greater than in previous processes for injecting coal as an auxiliary fuel into the hearth of a blast furnace.

In the majority of cases, the basic ash constituents occur in the form of $Fe_2O_3$, CaO, MgO, $Na_2O$ and $K_2O$, that is to say, in the form of basic oxides. Acid ash constituents involved are essentially $SiO_2$ and $P_2O_5$, and, as compounds which are in principle amphoteric, $Al_2O_3$ and $TiO_2$, although in foundry practice these are generally classed with acid components.

The following Examples set out two possible ways, when mixing brown coal or lignite and bituminous coal, of achieving a base-acid ratio of about 1 in the resulting mixture.

EXAMPLE 1

68.85% of brown coal (dry) is mixed with 31.15% of bituminous coal (dry).

EXAMPLE 2

76.83% of brown coal (dry) is mixed with 23.17% of bituminous coal (dry).

The different proportions of the two kinds of coals are because bituminous coals with different ash contents are used, the ash content of the bituminous coal in Example 2 being substantially higher than that used in Example 1. In both Examples, the same brown coal was used, having an ash content of 5.62% (dry) and the same ash composition.

EXAMPLE 1

| Characteristic | Component | | |
|---|---|---|---|
| | Brown coal dust | Bituminous coal dust | Mixture |
| Short analysis: | | | |
| water content % by weight | 11 | 1.0 | 8.11 |
| ash content % by weight | 5 | 9.9 | 6.41 |
| volatile constituents % by weight | 44 | 23.4 | 38.05 |
| C-fix % by weight | 40 | 65.7 | 47.43 |
| Elementary analysis (dry): | | | |
| carbon % by weight | 65.12 | 74.74 | 68.11 |
| hydrogen % by weight | 4.72 | 3.88 | 4.46 |
| oxygen % by weight | 23.31 | 8.66 | 18.75 |
| nitrogen % by weight | 0.76 | 1.72 | 1.06 |
| sulphur % by weight | 0.47 | 1.00 | 0.64 |
| ash content % by weight | 5.62 | 10.00 | 6.98 |
| Ash composition: | | | |
| $SiO_2$ % by weight | 9.5 | 46.2 | 25.88 |
| $Al_2O_3$ % by weight | 5.0 | 35.4 | 18.56 |

-continued

| Characteristic | Component | | |
|---|---|---|---|
| | Brown coal dust | Bituminous coal dust | Mixture |
| $Fe_2O_3$ % by weight | 15.0 | 2.0 | 9.20 |
| CaO % by weight | 41.0 | 5.6 | 25.21 |
| MgO % by weight | 14.0 | 1.9 | 8.60 |
| $K_2O$ and $Na_2O$ % by weight | 2.0 | 0.8 | 1.46 |
| $SO_3$ % by weight | 13.5 | 3.7 | 9.13 |
| Residue % by weight | — | 4.4 | 1.96 |
| Mixture ratio (dry) % by weight | 68.85 | 31.15 | 100.00 |

$$\frac{B}{A} = \frac{9.2 + 25.21 + 8.6 + 1.46}{25.88 + 18.56} = \frac{44.47}{44.44} \approx 1$$

EXAMPLE 2

| Characteristic | Component | | |
|---|---|---|---|
| | Brown coal dust | Bituminous coal dust | Mixture |
| Short analysis: | | | |
| water content % by weight | 11 | 1.00 | 8.87 |
| ash content % by weight | 5 | 14.85 | 7.10 |
| volatile constituents % by weight | 44 | 23.36 | 39.60 |
| C-fix % by weight | 40 | 60.79 | 44.43 |
| Elementary analysis (dry): | | | |
| carbon % by weight | 65.12 | 70.39 | 66.34 |
| hydrogen % by weight | 4.72 | 3.72 | 4.49 |
| oxygen % by weight | 23.31 | 8.28 | 19.83 |
| nitrogen % by weight | 0.76 | 1.61 | 0.96 |
| sulphur % by weight | 0.47 | 1.00 | 0.59 |
| ash content % by weight | 5.62 | 15.00 | 7.79 |
| Ash composition: | | | |
| $SiO_2$ % by weight | 9.5 | 46.2 | 25.88 |
| $Al_2O_3$ % by weight | 5.0 | 35.4 | 18.56 |
| $Fe_2O_3$ % by weight | 15.0 | 2.0 | 9.20 |
| CaO % by weight | 41.0 | 5.6 | 25.21 |
| MgO % by weight | 14.0 | 1.9 | 8.60 |
| $K_2O$ and $Na_2O$ % by weight | 2.0 | 0.8 | 1.46 |
| $SO_3$ % by weight | 13.5 | 3.7 | 9.13 |
| Residue % by weight | — | 4.4 | 1.96 |
| Mixture ratio (dry) % by weight | 76.83 | 23.17 | 100.00 |

$$\frac{B}{A} = \frac{9.2 + 25.21 + 8.6 + 1.46}{25.88 + 18.56} = \frac{44.47}{44.44} \approx 1$$

It will be seen therefore that the process as described hereinbefore makes it possible to use fine-grain bituminous coal, even when it is a high-ash coal.

Various modifications may be made in the above-described process without thereby departing from the spirit and scope of this invention.

What is claimed is:

1. A process for injecting a first fine-grain carbon carrier selected from a group consisting essentially of ash-bearing hard and bituminous coal having predominantly acid constituents in said ash, as a reducing agent for iron oxide, into the hearth of a blast furnace, comprising using a mixture of said first fine-grain carbon carrier and at least one other solid fine-grain ash-bearing carbon carrier selected from a group consisting essentially of brown coal, brown coal coke, peat, peat coke, sawdust and mixtures thereof having a basic ash content, wherein the composition of the mixture of said first and other fine-grain carbon carriers is so selected that the degree of basicity of the resulting overall ash of the mixture is substantially the same as the degree of basicity of the blast furnace slag.

2. A process as set forth in claim 1, wherein the other solid fine-grain component comprises brown coal.

3. A process as set forth in claim 1 wherein said other solid fine-grain agent comprises brown coal coke.

4. A process as set forth in claim 1 wherein said other solid fine-grain agent comprises brown coal and coke thereof.

5. A process as set forth in claim 1 wherein the other solid fine-grain component comprises peat.

6. A process as set forth in claim 1 wherein the other solid fine-grain component comprises peat coke.

7. A process as set forth in claim 1 wherein the other solid fine-grain component comprises peat and coke thereof.

8. A process as set forth in claim 1 wherein the other solid fine-grain component comprises sawdust.

9. A process as set forth in claim 1 wherein said injection is continuous.

10. A method of operating a blast furnace to reduce iron oxide including injecting a mixture of a first fine-grain carbon carrier selected from a group consisting essentially of hard and bituminous coal having a high ash content which contains predominantly acid constituents and at least one other solid fine-grain ash-bearing carbon carrier selected from a group consisting essentially of brown coal, brown coal, coke, peat, peat coke, sawdust and mixtures thereof having a basic ash content as reducing agent into the furnace, the composition of the mixture being so selected that a base-acid ratio is achieved in the resulting ash mixture which is substantially the same as the degree of basicity of the furnace slag.

* * * * *